US006474846B1

(12) United States Patent
Kelmelis et al.

(10) Patent No.: US 6,474,846 B1
(45) Date of Patent: Nov. 5, 2002

(54) FLUSH TRIM COLLAR LIGHTING SYSTEM

(76) Inventors: Victor Kelmelis, 3833 Bledsoe Ave., Los Angeles, CA (US) 90066; Maurice Cohen, 6517 Hayes Dr., Los Angeles, CA (US) 90048

( * ) Notice: Subject to any disclaimer, the term of this patent is extended or adjusted under 35 U.S.C. 154(b) by 0 days.

(21) Appl. No.: 09/264,224

(22) Filed: Mar. 5, 1999

(51) Int. Cl.[7] ..... F21S 1/06

(52) U.S. Cl. ..... 362/365; 362/368; 362/147; 248/231.91; 248/343

(58) Field of Search ..... 362/365, 364, 362/366, 368, 457, 147; 248/343, 342, 231.9, 231.91; 403/118, 408.1, 385, 335, 336, 337, 338

(56) References Cited

U.S. PATENT DOCUMENTS 3,518,420 A * 6/1970 Kripp ..... 362/365
3,666,040 A * 5/1972 Junk ..... 248/343
3,872,296 A * 3/1975 Cohen et al. ..... 362/365
4,274,615 A * 6/1981 Chan et al. ..... 362/365
4,809,468 A * 3/1989 Bareiss ..... 362/365
5,221,069 A * 6/1993 Struthers et al. ..... 248/343
5,373,431 A * 12/1994 Hayman et al. ..... 362/365
5,823,664 A * 10/1998 Demshki, Jr. et al. ..... 362/366

* cited by examiner

*Primary Examiner*—Thomas M. Sember
(74) *Attorney, Agent, or Firm*—Curtis L. Harrington

(57) ABSTRACT

A flush lighting system includes a support ring for attachment, typically to the underside surface, of a lighting fixture containment space, and a finishing ring which can lockably engage the support ring, either directly using threaded members, or by the use of raised dimples on the support ring which interfits with a groove on the finishing ring. The finishing ring preferably contains apertures and radius grooves for accommodating plaster or dry wall compound. A raised abbreviated radial width inner surface transition lies at the inner most portion of the face of the finishing ring. Inside the raised transition and extending axially is an engagement structure for mating with the support ring, through either a groove or apertures for threaded attachment against a radially outwardly existing axial surface of the support ring. The aforementioned system works well with an additional fixture engagement structure which typically lies within the lighting fixture and for which an additional holding structure provides some engagement to the lighting fixture, and particularly a structure which contemplates a fixture which mounts flush with the surrounding ceiling or wall and the finishing ring.

17 Claims, 5 Drawing Sheets

FLUSH TRIM COLLAR LIGHTING SYSTEM

FIELD OF THE INVENTION

The present invention relates to the field of lighting systems and more particularly to recessed lighting systems and provides a structure for facilitating a completely flush recessed lighting arrangement for an enhanced and finely customizable recessed lighting installation.

BACKGROUND OF THE INVENTION

Conventional recessed lighting systems offer a rivet-type installation in which structural and visually hidden portions of the light fixture are provided above and partially within a wall or ceiling barrier, and in which an engaging fixture is attached to the opposite side of the wall or ceiling with or without further rigid attachment to the portions of the light fixture on the other side. The engaging fixture, in order to hide the imperfections in the aperture extending through the wall or ceiling material, typically includes a generously proportioned cover flange. In the case of a ceiling, for example, the flange extends through the aperture, downward to a point at least below the ceiling level and then radially outward. The radial extent of the flange hides imperfections which occurred in the making of the through-hole, such as a tear in the dry wall sandwiching paper, deviations from circularity in the hole, etc.

Typically the radial extent is not flat, and curves downwardly more at the inner radial edge and usually tapers in the direction of its radial outermost extent. The taper provides more clearance space at the radial innermost extent to accommodate foreign objects, such as those formed by gauges in the dry wall, chips of torn paper at the rim, and the like. The shape of the radial extent can vary, and may include an abbreviated taper at the outermost extent for example. The object is to accommodate imperfections without further treatment and provide an outer sealing with respect to the wall or ceiling.

However, the radial design becomes a defacto part of the wall's finish. Moreover, the fixture is typically painted at the factory in a stock color such as white or eggshell and typically in a gloss or enamel finish. Most wall coverings are non-reflective and have a light dispersive finish. The fixture finish virtually never matches the wall color. In highly stylized surroundings, such as art galleries, and custom homes where great care and attention is given to the space, and objects within the space to be illuminated, adding the hodge podge of finishing collar designs to raw need for lighting is undesirable.

Lighting systems have other requirements which continue to demand to be met, including accessibility for cleaning, light bulb and reflector changes and preferably some ability to re-direct the position of the light source. An elimination of the intrusive shape and color of a flange collar can only be reasonably accomplished while leaving these other requirements in tact.

What is therefore needed is a system which meets all of the necessary requirements for lighting system operation and servicablity, but which facilitates a more custom installation. The needed system should be as structurally secure as a conventional system and facilitate a customized installation flush with the surrounding wall or ceiling.

SUMMARY OF THE INVENTION

A flush lighting system includes a support ring for attachment, typically to the underside surface, of a lighting fixture containment space, and a finishing ring which can lockably engage the support ring, either directly using threaded members, or by the use of raised dimples on the support ring which interfits with a groove on the finishing ring. The finishing ring preferably contains apertures and radius grooves for accommodating plaster or dry wall compound. A raised abbreviated radial width inner surface transition lies at the inner most portion of the face of the finishing ring. Inside the raised transition and extending axially is an engagement structure for mating with the support ring, through either a groove or apertures for threaded attachment against a radially outwardly existing axial surface of the support ring. The aforementioned system works well with an additional fixture engagement structure which typically lies within the lighting fixture and for which an additional holding structure provides some engagement to the lighting fixture, and particularly a structure which contemplates a fixture which mounts flush with the surrounding ceiling or wall and the finishing ring.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

The description and operation of the invention will be best initiated with reference to FIG. 1 and which illustrates a perspective view from below and looking upward at a flush trim collar lighting system 11. At the uppermost section is a light accommodation box 13 which is usually provided to more than adequately house the wiring and light support, and is typically made oversize in order to aid in heat dissipation. Accommodation box 13 has a light fixture accommodation aperture 14 at its lower side. A larger metal accommodation box 13 will result in a lower temperature and increased thermal dissipation.

Figure 1:
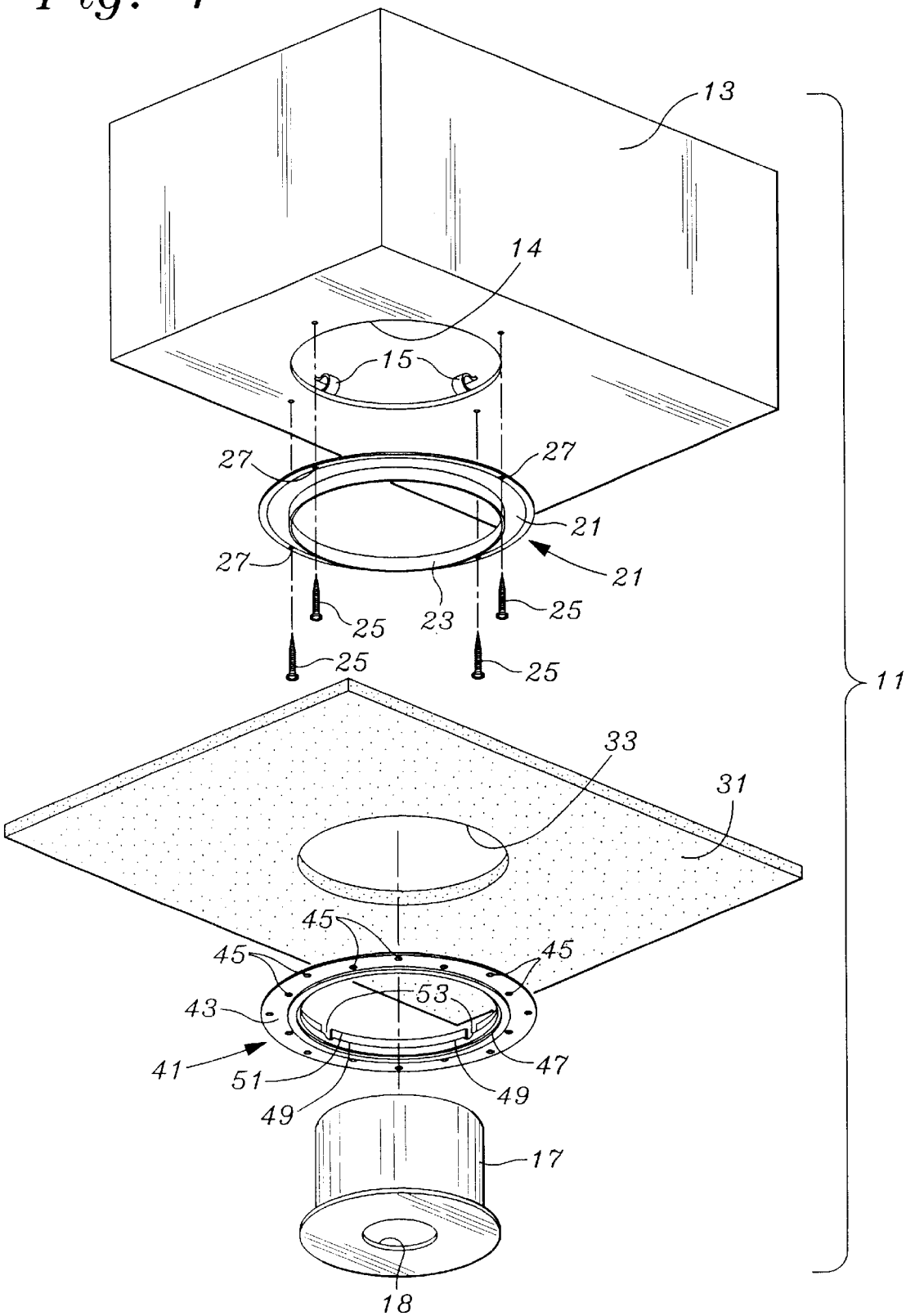
FIG. 1 is a perspective lower view of a lighting fixture accommodation box to which a support ring of the invention is attached, typically with four screws and overlying a ceiling board, finishing ring and also shown with a light fixture which fits within and through the finishing ring, ceiling board, support ring and through and protruding into the accommodation box.

Just inside the metal accommodation box 13 two friction clips 15 are noted which will make frictional contact with a removable fixture 17 having a light aperture 18, seen at the bottom of FIG. 1. The bottom of the removable fixture 17 is seen as having a lip or outermost radial structure which will be shown to engage a complementary structure to limit its extent of travel in the direction of box 13. Other shapes of light fixture 17 may be used and in conjunction with other limiting structures to limited the extent of travel toward box 13. In some cases the clips 15 will be mounted to other structures which may cooperate with any of the structures shown and described in system 11.

Just below the box 13, a support ring 19 includes a radially planar portion 21 which will ideally fit directly against the bottom of the box 13, and an axial portion 23 which, in the preferred embodiment, provides both strength and further structural support. A set of four screws 25 are used to extend through apertures 27 at the outer periphery of the support ring 19 to attach the support ring 19 to the box 13. This is typically done before the installation takes place, and the combination of the box 13 and support ring 19 may be available commercially as a pre-assembled unit. Manufacturing advantages may be had by using rivets, where a pre-assembled box 19 section is attached to the support ring 19 before the box 13 formation is complete.

The support ring 19 is shown just above a section of wall or ceiling board 31 having a central aperture 33 through which the axial portion 23 may partially extend. Ceiling board 31 may be plaster or dry wall. In most applications the ceiling board 31 will be already installed and the central aperture 33 will be cut with the dimensional clearances and attachment of box 13 taken to account.

Below the ceiling board 13 is a finishing ring 41. Finishing ring 41 has a radially extending flange 43 which is generally flat but may be tapered in the direction of the outermost periphery. Radially extending flange 41 may also be thin and may generally range from one eighth of an inch to about one sixteenth of an inch. The finishing ring 41 has a plurality of apertures 45 which may have a diameter of about one quarter of an inch to about an eighth of an inch. The apertures 45 help hold wall joint compound so that the wall finish can be brought over the radially extending flange 43 and up to a rim 47 seen as a prominent surface disposed on the same side of the radially extended flange 43 which will receive joint compound to finish the custom installation. In addition, the apertures 45 can also be used with nails having thin heads where the nails are driven into the apertures 45, but not left so high that the heads would extend above the natural application level of wall joint compound, sometimes referred to as spackle. Where nails are used, the upper nail structure, although displacing part of an aperture 45, helps to provide additional surface for the wall joint compound to take hold. Rim 47 demarks a radial limit at which the finishing compound approach toward the radial center of the finishing ring 41 will extend. As will be seen, the radially extending flange 43 also includes a plurality of radiused grooves which help to hold the wall joint compound in place over the radially extending flange 43.

The system 11 is generally seen as having an axis which extends through the accommodation box 13 opening, through the support ring 19, through the finishing ring 41 and fixture 17. The general axis of this system is a main axis through which the orientation of the other members may be described.

On the inside of the finishing ring 41 is a radially extending portion which includes an outwardly disposed groove, the rear of which is labeled as 49 which continues axially with an upper wall 51. Into the upper wall 51 are a series of cutouts 53. The cutouts 53 give access into the outwardly disposed slot and is generally the best way to open an upper portion of the slot to entry from projections, which will be shown, into the slot. In the alternative, small vertical grooves, leading into the radially outwardly disposed slot, may be provided. However, cutouts 53 are relatively easy to form and where the material of the finishing ring 41 is very thin, this is the preferred method.

Rim 47 is made wide enough in FIG. 1 to be observable, but in actual use it may be radially narrower or wider. The main function of the rim 47 is to provide a transition structure which separates the wall joint compound and the clearance for the ingress and egress of the fixture 17. The radial width of the rim 47 can be nearly razor thin. Another reason to have a wider rim is to provide sufficient structure against which scraping and sanding can occur. Where hand finishing is performed, the rim 47 can be quite thin, but where a mechanical sander is used, a wider rim, for a given material thickness, can withstand the rubbing away of material without loss of structural integrity. In addition, the rubbing away of material makes the surface of the rim 47 more amenable to holding paint and causes the transition between wall joint compound and metal surface of the rim 47 to be more nearly seamless.

Figure 2:
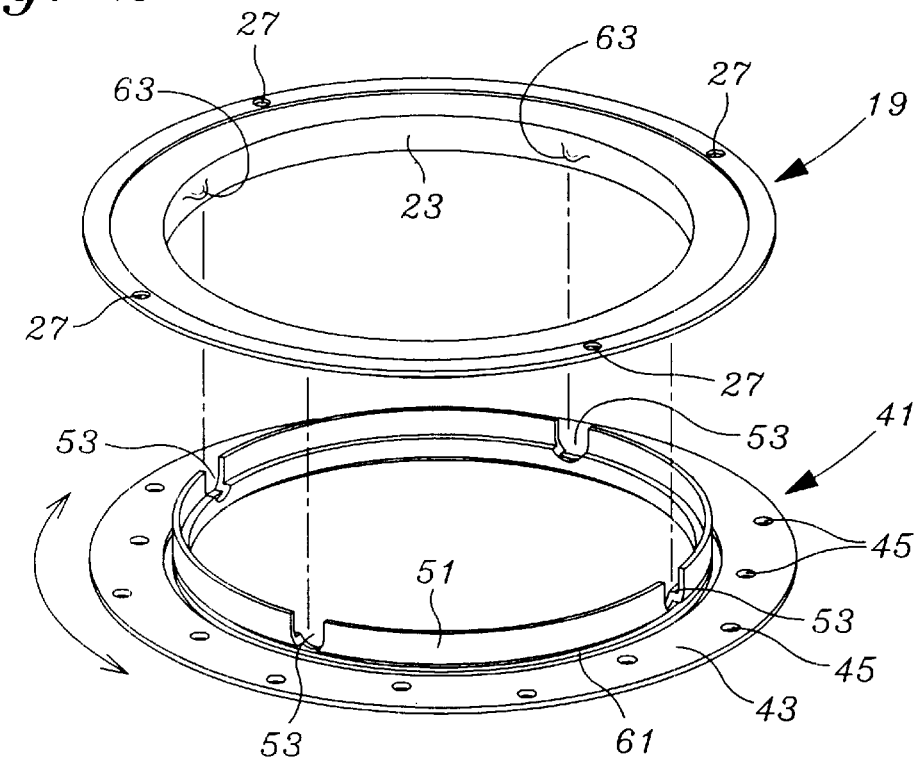
FIG. 2 is an isolated view of the support ring and finishing ring where the support ring contains dimple projections radially toward the center of the support ring, and where the finishing ring includes an outwardly disposed groove into which the dimple projections interfit and engage the finishing ring.

Referring to FIG. 2, a view above the separated supporting ring 19 and finishing ring 41 exposes the radially outwardly disposed groove 61, and more clearly indicates how the series of cutouts 51 provide access from above. The axial portion 23 of the supporting ring 19 is seen as having a series of inwardly protruding engagement structures 63 which align with the cutouts 51 and which can ride in the slot 61 and enable the supporting ring 19 to engage and support the finishing ring 41. Any number of engagement structures 63 can be used so long as a matching series of cutouts 53 are properly aligned to accommodate them. In the system 11 with the cutouts 53 and inwardly protruding engagement structures 63, the finishing ring 61 need only have its cutouts 53 aligned with the projections 63, followed by a raising of the finishing ring 41 to bring the protruding engagement structures 63 into alignment with the groove 61 and then turn the finishing ring 41 either clockwise or counter clock wise to position the protruding engagement structures 63 in the slot 61 between two adjacent cut outs 53. In this position, the finishing ring 41 is secured with respect to the support ring 19, and in an installation with the ceiling board 31 sandwiched in between.

Figure 3:
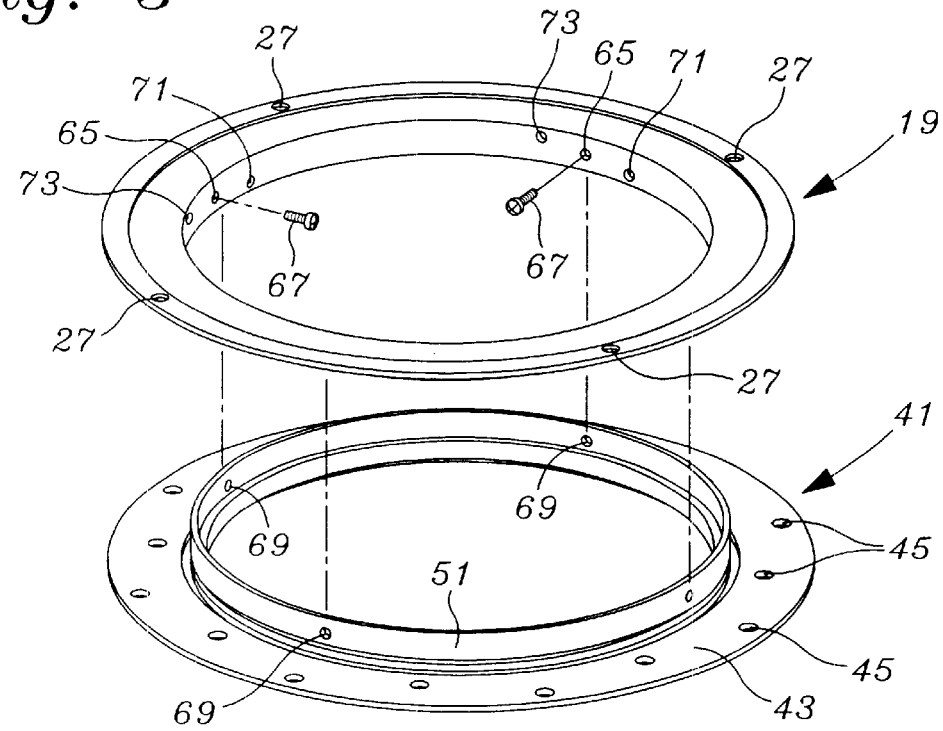
FIG. 3 is an isolated view of the support ring and finishing ring where the finishing ring carries apertures and where the support ring may contain a series of different axial height apertures for different thicknesses of wall or ceiling board or no apertures to facilitate the drilling of apertures to exactly match the axial displacement of the support ring with respect to the finishing ring.

In another embodiment, seen in FIG. 3, a variation is shown in which the support ring 19 carries a series of apertures 65 which may be threaded, and engageable with a series of screws 67. The screws 67 engage the apertures 65 of the support ring 19 through apertures 69 of the finishing ring 41. This provides a direct attachment method, and can be used to make custom installations. For example, where the thickness of the ceiling board 31 is thinner or thicker, the holes 65 can be drilled to match for a custom fit, or a series of apertures 65 can be provided which are radially shifted and axially varied. An example is seen as aperture 71 to one side of aperture 65 which is higher up and as an aperture 73 to the other side of aperture 65 which is lower down. If the axial heights are still unacceptable, the apertures 69 can be positioned over a portion of the upper wall 51 having no apertures 65, 71, or 73, and a matching hole drilled. As such, the attachment structure seen in FIG. 4 works well with odd thickness size wall board 31.

Figure 4:
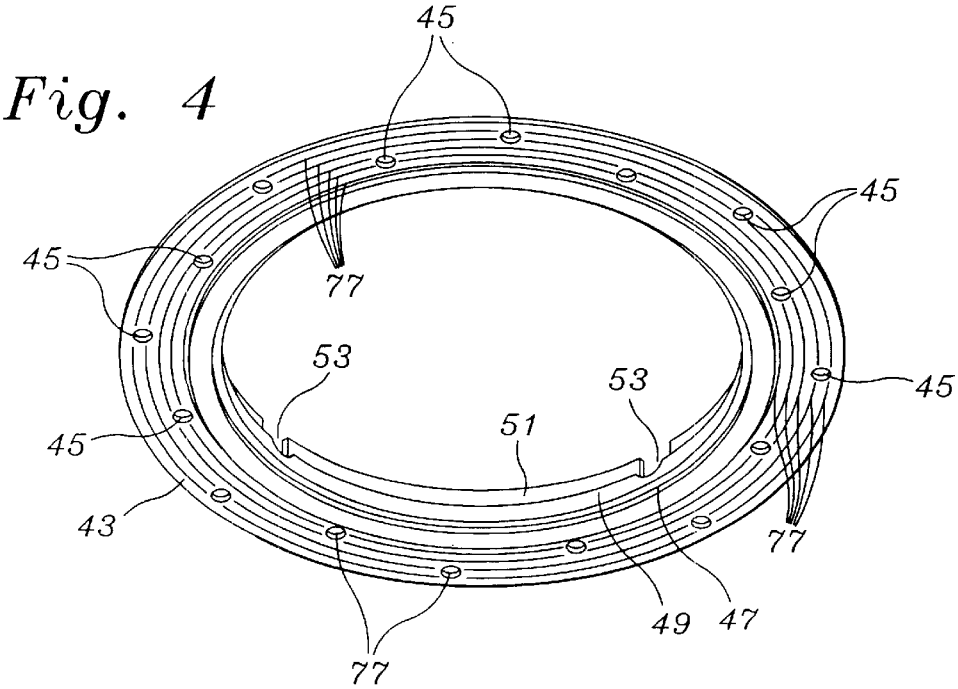
FIG. 4 is a perspective view of the finishing ring showing an expanded view of the apertures and grooves which facilitate the retention of wall joint compound.

FIG. 4 is a perspective view of the finishing ring 41 showing an expanded view of the apertures and grooves 77 which facilitate the retention of wall joint compound.

Figure 5:
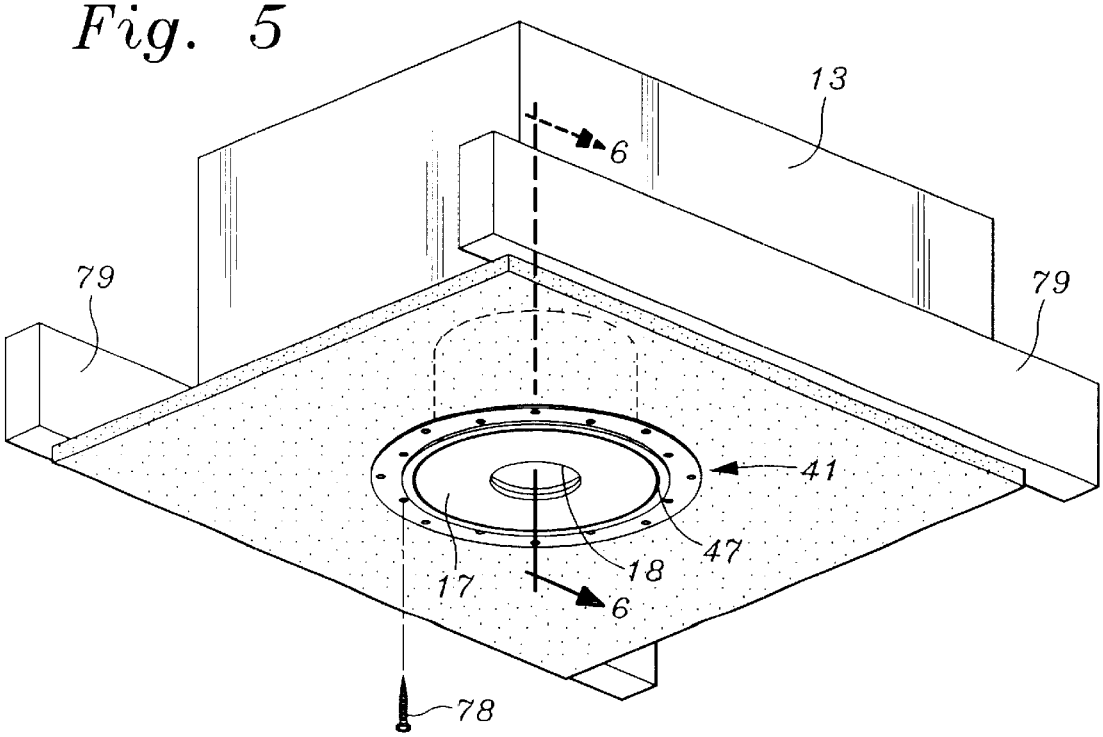
FIG. 5 is an assembled view of the flush fixture system seen in exploded perspective in FIG. 1 before the addition of wall joint compound.

FIG. 5 is an assembled view of the flush fixture system 11 seen in exploded perspective in FIG. 1 with the finishing ring 41 seen before the addition of wall joint compound and possibly held in place with the addition of a fastening structure 78 which may be a nail or a dry wall screw. FIG. 5 illustrates the assembled structure as seen with respect to beams 79. The underside of the fixture 17 is seen. In the fully finished configuration, only the fixture 17 and possibly the rim 47, assuming that it is not otherwise finished and painted, will be seen. Where the rim 47 is sanded along with the joint compound, only the ceiling's painted surface (not shown) and the bottom surface of the fixture 11 will be seen. The section lines and orientation facilitate further explanation in the following Figures.

Figure 6:
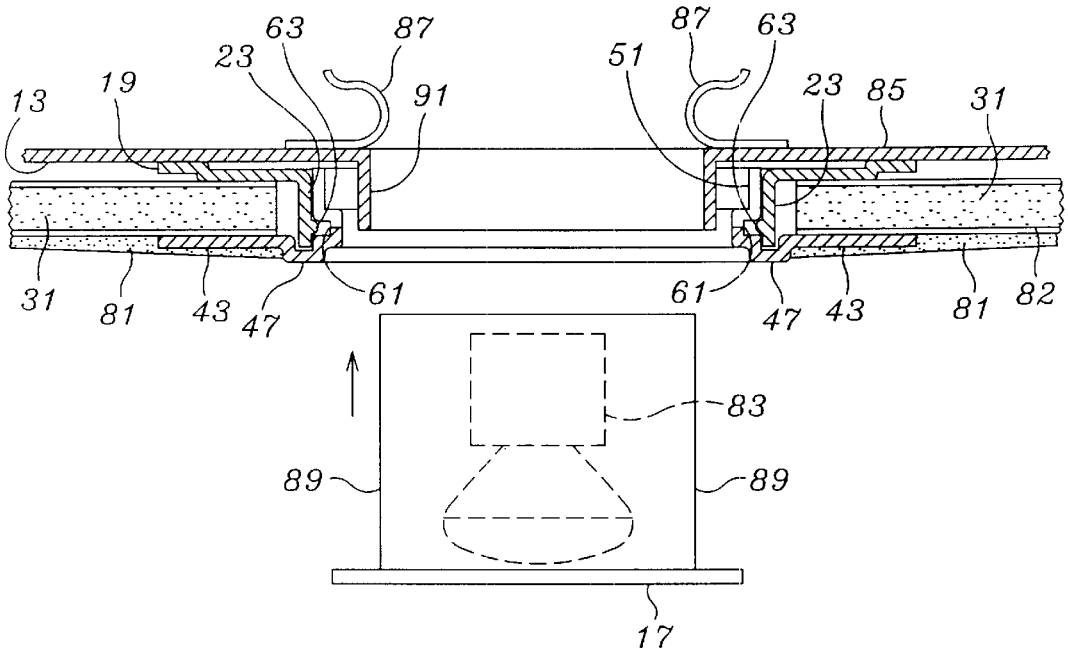
FIG. 6 is a sectional view taken along line 6 of FIG. 5 and illustrating the addition of wall joint compound over the structures on the planar outer radial surface of the finishing ring and shown with the access afforded with the fixture removed.

FIG. 6 is a sectional view taken along line 6—6, along a main axial extent of the system, and seen in FIG. 5 and illustrating the addition of wall joint compound 81 leading up to and over the structures on the planar surface of the outer radial portion 43 of the finishing ring 41. As can be seen, the finishing ring 41 radially extending flange 43 extends downward from the lower surface of the ceiling board 31. Where a more customized finish is desired, a chamfer can be formed in the lower portion of the wall or ceiling board 31 by simply scribing a radius of a lower paper layer 82 equivalent to or greater than the radius of the finishing ring 41 and peeling it away. If further depth of chamfer is desired, some of the wall or ceiling board material 31 can be scraped away. Over chamfering will not be harmful and will help to further seat the finishing ring 41, although chamfering will probably not be necessary due to the thinness of the radially extending flange 43.

The fixture 17 is seen enclosing a light support 83 shown in phantom. Typically the light support 83 will support a lamp and enable positional aiming adjustment through the light aperture 18 seen in FIG. 5. The box 13 is seen has having a lower wall 85 supporting clips 87 which are positioned to frictionally engage a side wall 89 of the fixture 17. The box 85 may include either as an integral part or as a bracket upholding the clips 87, a downwardly extending axial wall 91. Clips 87 will typically be radially dispersed to exert equal opposing force on the fixture 17. The wall 91 is distinguishable from the wall 23 of the of the support ring 19. Also seen is the wall or ceiling board 31 now seen sandwiched between the support ring radial planar portion 21 and the finishing ring 21 radially extending flange 43. Also clearly seen are the of inwardly protruding engagement structures 63 which are engaging the slot 61, and enable the supporting ring 19 to engage and support the finishing ring 41.

Figure 7:
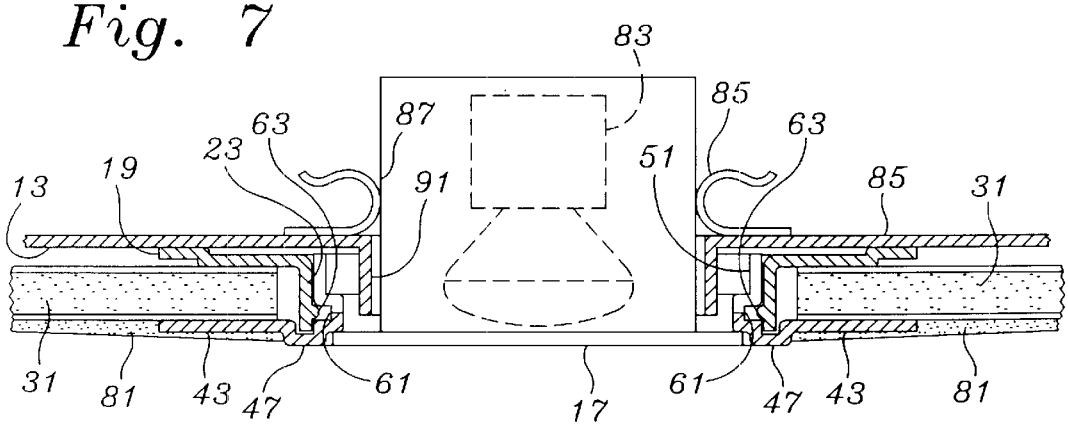
FIG. 7 is a sectional view as seen in FIG. 6, but with the fixture in place and illustrating the final, flush appearance of the flush fixture system of the invention.

FIG. 7 is a sectional view as seen in FIG. 6, but with the fixture 17 in place and illustrating the final, flush appearance of the flush fixture system 11 of the invention.

The installation of the system 11 is quite simple. First, a larger metal accommodation box 13 is typically fitted already with a support ring 19. Into the wall or ceiling board 31 is formed a central aperture 33 just beneath where the box 13 is to be mounted. Next the box 13 is secured, typically with respect to beams rafters or other structural members of a building, in a position where the support ring 19 may partially fit through the central aperture 33. Next, the finishing ring 41 upper wall 51, which is a cylindrical shape, is moved upwardly and into the axial portion 23 of the support ring 19 such that the inwardly protruding engagement structures 63 fit within the radially outwardly disposed groove. A short turn of the finishing ring secures it into place and such the radially extending flange 43 should lie closely adjacent to the surrounding wall or ceiling board 31 and flatly against it. Next, the joint compound is applied to the wall or ceiling board 31 around the finishing ring 41 and onto the finishing ring 41 up to the rim 47. Typically smoothing will be performed by a wide blade tool. Once the joint compound dries, the whole area is sanded and the addition of joint compound possibly repeated. The surrounding surfaces, joint compound and possibly the rim 47 are now ready for painting.

Figure 8:
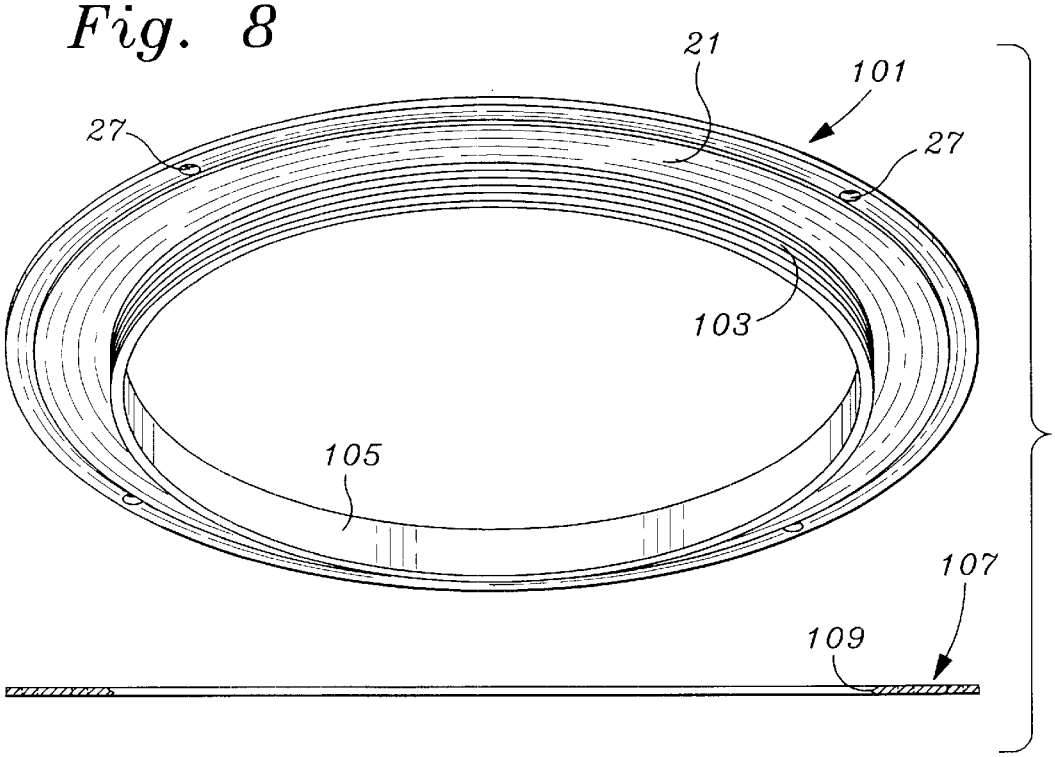
FIG. 8 is a variation on the system of the invention shown in FIG. 2, but where the support ring has a threaded axial portion and where the finishing ring simply threads onto the axial portion of the support ring, with any excess length of the axial portion acting as a rim to limit the innermost extent of the dry wall compound.

A further variation on the connectability of a support ring 101 is seen in FIG. 8 by providing threads 103 on an outer surface of an axial portion 105 of the support ring 101. A finishing ring 107 has an internal thread 109 or has an internal surface suitable for interactably engaging a threaded surface. The excess of the axial portion 105 which goes past the finishing ring 107 forms a stop or rim similar to rim 47 to limit the concentric inner extent of drywall compound.

Figure 9:
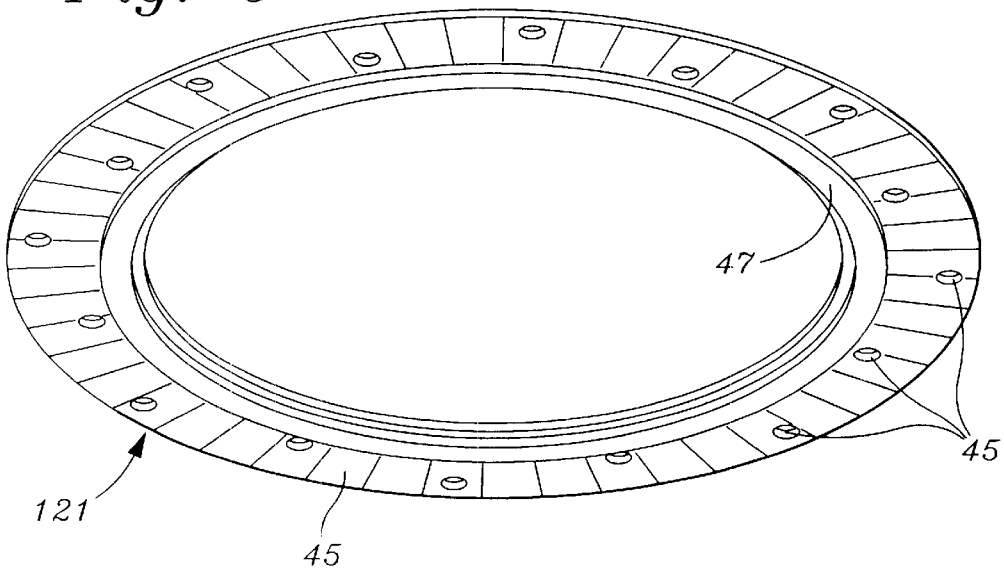
FIG. 9 is the simplest variation of the invention as a free standing ring having a rim for limiting the joint compound radially inner extension and which would be held in solely by dry wall screws or by nails.

Another variation is seen in FIG. 9 where a finishing ring 121 is provided which is not intended to link up with a support ring. The finishing ring 121 contains the rim 47 and radially extending flange 43 seen in FIG. 2, but requires other methods and structures to attach, such as the dry wall screw, nail or like structure 78 of FIG. 5, as well as glue or other holding structures.

While the present invention has been described in terms of an flush trim collar lighting system, the principles contained therein are applicable to other types of custom finishing systems.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A flush trim collar assembly for a lighting system comprising:

a support structure, for attachment to an anchoring structure, having a radially extending portion and a first axially extending portion; and a finishing ring having a radial planar portion for supporting finishing compound and a second axially extending portion connected to said radial planar portion and said second axially extending portion including structure to facilitate attachment to said first axially extending portion of said support structure, one of said first and said second axially extending portions fitting concentrically within the other of said first and said second axially extending portions and wherein said radial planar portion of said finishing ring has a first side disposed away from said second axially extending portion and a second side disposed toward said second axially extending portion and includes apertures and grooves on said first side of said radial planar portion of said finishing ring to facilitate the engagement and holding of said finishing compound.

2. The flush trim collar assembly as recited in claim 1 wherein said finishing ring includes a rim portion which lies between said radial planar portion of said finishing ring and said second axially extending portion, and having a prominent surface disposed away from said second axially extending portion, said rim portion to structurally provide a limit when said finishing compound is applied in a direction of a center of said finishing ring.

3. The flush trim collar assembly as recited in claim 1 wherein said second axially extending portion of said finishing ring carries a plurality of attachment apertures and further comprising attachment screws for engagement with said attachment apertures and into said first axially extending portion of said support structure to support said finishing ring with respect to said support structure.

4. The flush trim collar assembly as recited in claim 1 and further comprising a light fixture fittable through said finishing ring and at least partially past said support structure and at least flush with a portion of said finishing ring.

5. The flush trim collar assembly as recited in claim 4 and wherein said light fixture has a surface which interfits with a surface on said finishing ring to limit travel of said light fixture through said finishing ring.

6. The flush trim collar assembly as recited in claim 1 wherein said support structure is a ring and wherein said radially extending portion is a circular plate and wherein said first axially extending portion has an open cylindrical shape.

7. The flush trim collar assembly as recited in claim 1 and further comprising an expanse of barrier board having a first side and a second side and having a barrier board aperture extending from said first side through to said second side, said barrier board aperture through which said first axially extending portion of said support structure extends from said first side and said second axially extending portion of said finishing ring at least partially extends from said second side for engagement with said first axially extending portion of said support structure.

8. The flush trim collar assembly as recited in claim 7 and wherein at least a portion of said barrier board is sandwiched between said radially extending portion of said support structure and said radial planar portion of said finishing ring.

9. A flush trim collar assembly for a lighting system for use adjacent a planar barrier comprising:

a support structure, for attachment to an anchoring structure, having a radially extending portion and a first axially extending portion; and a finishing ring having a radial planar portion for supporting finishing compound and a second axially extending portion connected to said radial planar portion and said second axially extending portion including structure to facilitate attachment to said first axially extending portion of said support structure, to fix said finishing ring with respect to said planar barrier, one of said first and said second axially extending portions fitting concentrically within the other of said first and said second axially extending portions wherein said second axially extending portion of said finishing ring carries a radially outwardly disposed groove having at least one axially disposed entry and wherein said first axially extending portion of said support structure carries a radially inwardly disposed protruding engagement structure for entering said at least one axially disposed entry and fitting within said radially outwardly disposed groove to secure said finishing ring with respect to said support structure.

10. The flush trim collar assembly as recited in claim 9 wherein a number of axially disposed entries equals a number of said radially inwardly disposed protruding engagement structures.

11. The flush trim collar assembly as recited in claim 10 wherein said axially disposed entry is a notch formed in said second axially extending portion of said finishing ring.

12. The flush trim collar assembly as recited in claim 9 and further comprising a light fixture fittable through said finishing ring and at least partially past said support structure and at least flush with a portion of said finishing ring.

13. The flush trim collar assembly as recited in claim 12 and wherein said light fixture has a surface which interfits with a surface on said finishing ring to limit travel of said light fixture through said finishing ring.

14. A flush trim collar assembly for a lighting system for use adjacent a planar barrier comprising:

a support structure, for attachment to an anchoring structure, having a radially extending portion and a first axially extending portion; and a finishing ring having a radial planar portion for supporting finishing compound and a second axially extending portion connected to said radial planar portion and said second axially extending portion including structure to facilitate attachment to said first axially extending portion of said support structure, to fix said finishing ring with respect to said planar barrier, one of said first and said second axially extending portions fitting concentrically within the other of said first and said second axially extending portions and further comprising an accommodation box to which said support structure is affixed, said accommodation box having a light fixture accommodating aperture, said accommodation box to enable a light fixture to extend through said finishing ring and at least partially past said support structure and into said accommodation box and at least flush with a portion of said finishing ring.

15. The flush trim collar assembly as recited in claim 14 and wherein said accommodation box supports a plurality of supporting clips directed toward a center of said light fixture accommodating aperture for engaging said light fixture.

16. A flush trim collar assembly for a lighting system:

a support structure for attachment to an anchoring structure having a radially extending portion and a first axial portion having a threaded exterior; and a finishing ring having a radial planar portion for supporting finishing compound and a central aperture for threaded engagement with said threaded exterior of said support structure, a length of said first axial portion traversed by threaded engagement of said finishing ring and extending outside of said finishing ring to structurally provide a limit when said finishing compound is applied in a direction of a center of said finishing ring.

17. A process for installing a flush trim collar light system comprising the steps of:

providing a support ring having a radial portion and a first axial portion;

forming central aperture in an expanse at board having a first side and a second side;

mounting said support ring on said first side of said board with said axial portion extending at least partially into said central aperture;

mounting a finishing ring having a radial planar portion for supporting finishing compound and a second axially extending portion, adjacent said central aperture with said second axially extending portion extending at least partially into said central aperture;

applying joint compound over said radial planar portion of said finishing ring; and attaching a light fixture at least partially through said finishing ring.

* * * * *